US009491981B2

(12) United States Patent
Suffolk et al.

(10) Patent No.: US 9,491,981 B2
(45) Date of Patent: Nov. 15, 2016

(54) TOE WEDGE FOR A BALLET POINTE SHOE

(71) Applicant: Drew Layne, LLC, Lantana, TX (US)

(72) Inventors: Mark Suffolk, Lantana, TX (US); Keri Suffolk, Lantana, TX (US)

(73) Assignee: Drew Layne, LLC, Lantana, TX (US)

( * ) Notice: Subject to any disclaimer, the term of this patent is extended or adjusted under 35 U.S.C. 154(b) by 86 days.

(21) Appl. No.: 14/373,993

(22) PCT Filed: Dec. 28, 2012

(86) PCT No.: PCT/US2012/071888

§ 371 (c)(1),
(2) Date: Jul. 23, 2014

(87) PCT Pub. No.: WO2013/101967

PCT Pub. Date: Jul. 4, 2013

(65) Prior Publication Data

US 2015/0007455 A1 Jan. 8, 2015

Related U.S. Application Data

(60) Provisional application No. 61/581,373, filed on Dec. 29, 2011.

(51) Int. Cl.
*A43B 5/12* (2006.01)
*A43B 13/00* (2006.01)
(Continued)

(52) U.S. Cl.
CPC . *A43B 5/12* (2013.01); *A43B 7/14* (2013.01); *A43B 7/1405* (2013.01);
(Continued)

(58) Field of Classification Search
CPC ..... A43B 5/12; A43B 7/14; A43B 7/1405; A43B 7/1465; A43B 7/24; A43B 7/28;
(Continued)

(56) References Cited

U.S. PATENT DOCUMENTS 1,953,659 A 4/1934 Savino
4,333,472 A * 6/1982 Tager ..... A43B 7/1425 36/140
(Continued)

FOREIGN PATENT DOCUMENTS

WO 2004107895 A1 12/2004
WO 2007029964 A1 3/2007
(Continued)

OTHER PUBLICATIONS

Foreign Communication From a Related Counterpart Application, International Preliminary Report on Patent Ability dated Jul. 10, 2014, International Application No. PCT/US2012/71888 filed on Dec. 28, 2012.
(Continued)

*Primary Examiner* — Clinton T Ostrup
*Assistant Examiner* — Cameron A Carter

(57) ABSTRACT

A ballet pointe shoe having a sole, an upper, a toebox, a platform, a shank, and a heel is disclosed. The ballet pointe shoe comprises a more rigid portion and a less rigid portion. The more rigid portion is above the sole and below the upper. The more rigid portion has a graduated increasing thickness at least partially inside the toebox and toward the platform. The more rigid portion diminishes to a remaining thickness toward the heel.

20 Claims, 5 Drawing Sheets

(51) Int. Cl.

| | |
|---|---|
| ***A43B 3/14*** | (2006.01) |
| ***A43D 1/00*** | (2006.01) |
| ***A43B 3/10*** | (2006.01) |
| ***A43B 23/02*** | (2006.01) |
| ***A43B 23/07*** | (2006.01) |
| ***A43C 11/00*** | (2006.01) |
| ***A43B 23/08*** | (2006.01) |
| ***A43B 23/10*** | (2006.01) |
| ***A43B 23/00*** | (2006.01) |
| ***A43B 7/14*** | (2006.01) |
| ***A43B 23/16*** | (2006.01) |
| ***A43B 7/28*** | (2006.01) |
| ***A43B 7/24*** | (2006.01) |
| ***A43B 17/16*** | (2006.01) |
| ***A43B 17/18*** | (2006.01) |
| ***A43B 19/00*** | (2006.01) |

(52) U.S. Cl.
CPC ..... *A43B 7/1465* (2013.01); *A43B 7/24* (2013.01); *A43B 7/28* (2013.01); *A43B 17/16* (2013.01); *A43B 17/18* (2013.01); *A43B 19/005* (2013.01)

(58) Field of Classification Search
CPC ..... A43B 17/16; A43B 17/18; A43B 19/005
USPC ..... 36/88, 25 R, 8.3, 10, 89, 45, 50.1, 11, 36/8.4
See application file for complete search history.

(56) References Cited

U.S. PATENT DOCUMENTS 5,129,165 A * 7/1992 Woodle ..... A43B 5/12 36/8.3
5,191,726 A * 3/1993 Vallee ..... A43B 5/12 36/113
5,220,735 A 6/1993 Raoul-Duval
5,469,641 A 11/1995 Subotic
5,740,618 A 4/1998 Minden
6,092,314 A * 7/2000 Rothbart ..... A43B 7/141 36/140
6,182,380 B1 2/2001 Liley
6,238,359 B1 * 5/2001 Anderson ..... A61F 5/14 36/43
D499,958 S * 12/2004 Crane ..... D8/402
7,036,244 B1 * 5/2006 Finch ..... A43B 5/12 36/113
7,900,375 B2 3/2011 Thoraval
7,921,579 B1 4/2011 French
2005/0022421 A1 * 2/2005 Bruckner ..... A43B 23/081 36/8.3
2007/0000149 A1 * 1/2007 Juniman ..... A43C 11/006 36/8.3
2008/0209761 A1 * 9/2008 Thoraval ..... A43B 23/087 36/8.3
2009/0151200 A1 * 6/2009 Niedermeyer ..... A43B 5/12 36/88
2010/0263231 A1 * 10/2010 Smirman ..... A43B 5/1641 36/43
2011/0010963 A1 * 1/2011 Webb ..... A43B 7/26 36/43
2011/0265348 A1 * 11/2011 Schmutte ..... A43B 5/12 36/93
2012/0055045 A1 * 3/2012 Wang ..... A43B 7/1425 36/88

FOREIGN PATENT DOCUMENTS

WO 2010132364 A2 11/2010
WO 2013101967 A1 7/2013

OTHER PUBLICATIONS

Foreign Communication From a Related Counterpart Application, International Search Report dated Apr. 26, 2013, International Application No. PCT/US2012/71888 filed on Dec. 28, 2012.

* cited by examiner

TOE WEDGE FOR A BALLET POINTE SHOE

CROSS-REFERENCE TO RELATED APPLICATIONS

The present application is a filing under 35 U.S.C. 371 and National Stage of International Application No. PCT/US2012/71888, filed Dec. 28, 2012 and entitled "Toe Wedge for a Ballet Pointe Shoe," which claims priority to U.S. Provisional Application 61/581,373, filed Dec. 29, 2011 and entitled "Toe Wedge for a Ballet Pointe Shoe," both of which are incorporated herein by reference in their entirety for all purposes.

BACKGROUND

A ballet pointe shoe is a type of shoe worn by ballet dancers when performing pointe work (i.e. dancing "en pointe"). "En pointe" means "on the tip" and is part of a classical ballet technique in which dancers perform on the tips of their toes. Ballet pointe shoes developed from the desire for dancers to appear weightless and sylph-like. A dancer's ability to achieve proper "en pointe" stance, that is, her ability to "get over" onto the platform (the flat part) of the ballet pointe shoe, is dependent on a combination of her strength and flexibility as well as the support structure of her ballet pointe shoes.

SUMMARY

In one embodiment of the disclosure, a ballet pointe shoe having a toebox, a platform, a heel, a sole, a shank, and an upper is disclosed. The ballet pointe shoe comprises a more rigid portion and a less rigid portion. The more rigid portion is above the sole and below the upper. The more rigid portion has a graduated increasing thickness at least partially inside the toebox and toward the platform and diminishes to a remaining thickness toward the heel.

In another embodiment of the disclosure, a toe wedge for use in a ballet pointe shoe is provided. The toe wedge comprises a top surface, a bottom surface, a thicker end, and a thinner end. The ballet pointe shoe has a toebox, a platform, a heel, a sole, a shank, and an upper. The toe wedge is configured to fit into the ballet pointe shoe with the thicker end towards the platform and the thinner end towards the heel. The toe wedge is above the sole and below the upper, and the bottom surface of the toe wedge is approximately parallel to the sole.

In yet another embodiment of the disclosure, a method of using a toe wedge in a ballet pointe shoe is provided. The method comprises placing the toe wedge into the ballet pointe shoe. The toe wedge comprises a thicker end and a thinner end. The ballet pointe shoe has a toebox, a platform, a heel, a sole, a shank, and an upper. The toe wedge is placed into the ballet pointe shoe with the thicker end towards the platform and the thinner end towards the heel.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
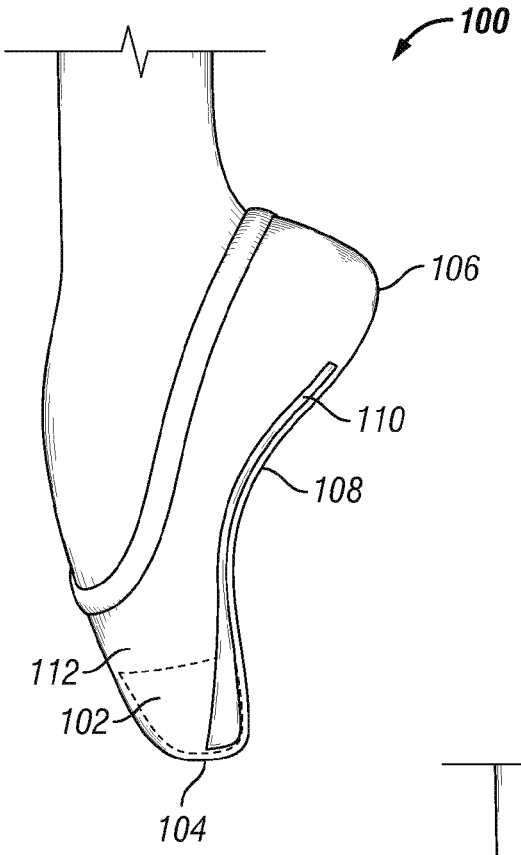
FIG. 1 illustrates a ballet pointe shoe according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Dancing "en pointe" requires dancers to use muscles throughout the entire body, including the legs, back and abdominal muscles. In order to achieve "en pointe" stance in proper form, a dancer must have the strength to engage the correct muscles which assist the dancer in "getting over" or getting up onto the platform (flat part) of the ballet pointe shoe. Some ballet dancers are capable of achieving "en pointe" stance in a typical ballet pointe shoe, while others have difficulty "getting over," due in some instances to lack of strength or muscle training in their foot, ankle, and leg muscles.

The pending disclosure teaches a ballet pointe shoe and components for use with a ballet pointe shoe which assist dancers in achieving proper "en pointe" stance. In an embodiment, the ballet pointe shoe comprises a more rigid portion having a graduated increasing thickness toward the platform and a diminishing remaining thickness toward the heel. The pending disclosure provides the necessary support to assist the dancer with "getting over" onto the platform of the ballet pointe shoe in proper form (resulting in the platform being horizontal to the floor) as well as ensuring the dancer has the correct form while in "en pointe."

In pointe work, it is most visually appealing, and therefore desirable, that dancers have exceptionally straight lines. This means that when a dancer is "en pointe," the dancer's body is balanced and centered over the platform of the ballet pointe shoe such that if you were to draw a line perpendicular through the center of the platform of the ballet pointe shoe, it would follow the centerline of the dancer's body.

In addition to having difficulty getting "en pointe," some dancer's have issues with "twisting." If a dancer is a "twister," her feet naturally twist out or away from the centerline of the platform. The twisting motion is typically most noticeable by observing a dancer's heels while "en pointe." Some practitioners have attempted to fix or correct this twisting motion by addressing the placement of a dancer's heel in the ballet pointe shoe. However, in pointe work, the heel is merely the symptom of the problem. In an embodiment, the pending disclosure addresses the problem—proper placement of the front of the foot—by diminishing a segment of the more rigid portion to approximate the space occupied by a dancer's big toe so that the big toe rests closer to the sole of the shoe than the dancer's remaining toes. Once the front of the dancer's foot is in the correct position, the heel naturally follows into the correct position due to the anatomical structure of the human foot.

The pending disclosure may be built into the support structure of the ballet pointe shoe or achieved by inserting a separate component into an existing ballet pointe shoe. Regardless, once the disclosed embodiment assists the dancer in properly position her feet for "en pointe" stance, her correct muscles are engaged and the necessary muscle tone develops so that the dancer ultimately trains her muscles to achieve the proper "en pointe" stance. In other words, the pending disclosure will not only help a dancer achieve proper "en pointe" stance, but will simultaneously facilitate the development of the motor skills and muscle memory necessary to improve her dancing ability. Ideally, after a certain amount of time using the pending disclosure, a dancer may have developed the adequate strength and/or muscle training to achieve proper "en pointe" stance without further assistance required from the pending disclosure. In a sense, the pending disclosure may be used as a training device, which educates the dancer, in technique, muscle memory and motor skills to reach the desired level of performance. In some instances, long term advantages may be retained or reinforced by continued use even by the most experienced dancers.

Figure 2A:
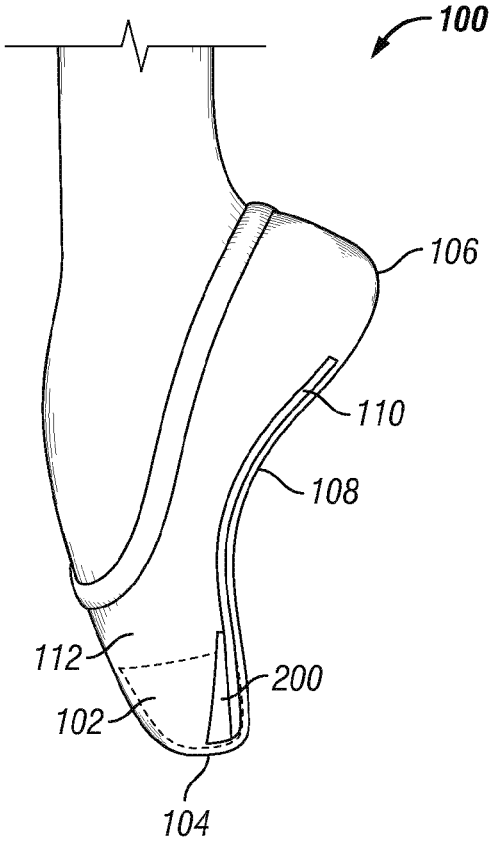
FIG. 2A illustrates a ballet pointe shoe according to another embodiment of the disclosure.
Figure 2B:
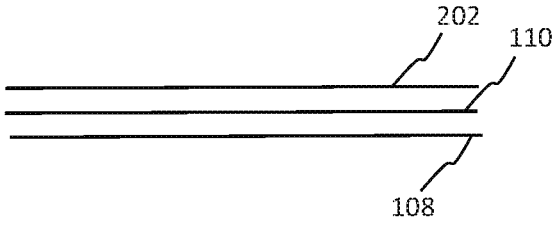
FIG. 2B illustrates a schematic of an embodiment of a ballet pointe shoe.

FIGS. 1 and 2A illustrate an embodiment of a ballet pointe shoe 100, having a toebox 102, a platform 104, a heel 106, a sole 108, a shank 110, and an upper 112. The toebox 102 is located in the front end of the ballet pointe shoe 100 and is a hard enclosure that encases and supports a dancer's toes. The front end of the toebox 102 is flattened so as to form the platform 104. The ballet pointe shoe compresses the dancer's foot and the platform 104 functions as a contact surface to the floor, on which a dancer balances when in "en pointe" stance. The heel 106 of the ballet pointe shoe 100 is located at the back of the ballet pointe shoe 100, opposite the platform 104, and does not typically offer any structural support to the dancer. The sole 108 is the bottom part of the ballet pointe shoe 100, which in most ballet pointe shoes, is constructed from a single piece of leather attached to the shoe with adhesive reinforced by stitching along its edges. The shank 110 is a piece of rigid material that serves to stiffen the sole 108 to provide support for the arch of a dancer's foot when in "en pointe" stance. Shanks are typically made from leather, plastic, cardstock, or layers of glue-hardened burlap and are generally designed with a sufficient rigidity to support the body weight of a dancer, while still offering enough flexibility for a dancer to move her foot as necessary within the ballet pointe shoe 100. As illustrated in FIG. 2B, the shank 110 is often covered by a thin fabric 202, which directly contacts the bottom of the dancer's foot. The upper 112, typically made of satin or canvas, covers the exterior of the ballet pointe shoe 100, concealing the box and other internal structural elements, lending an aesthetically pleasing look to the shoe, as depicted in FIGS. 1 and 2A.

The ballet pointe shoe 100 comprises a more rigid portion and a less rigid portion. The more rigid portion of the ballet pointe shoe 100 provides at least part of the structural support of the ballet pointe shoe 100 to sustain the body weight of a dancer while allowing enough flexibility for a dancer to achieve and transition between the required ballet stances. The less rigid portion of the ballet pointe shoe 100 may include other components of the ballet pointe shoe 100 which do not provide structural support, such as, for example, the upper 112, the heel 106, and ribbons (not depicted in FIGS. 1 and 2). In an embodiment, the more rigid portion of the ballet pointe shoe 100 is above the sole 108 and below the upper 112, and has a graduated increasing thickness at least partially inside the toebox 102 and toward the platform 104, and diminishes to a remaining thickness toward the heel. The graduated increasing thickness provides additional support to the front of a dancer's foot, such that a dancer that was not previously able to "get over" onto the platform 104 of the ballet pointe shoe 100, may engage the correct muscles to "get over" and achieve "en pointe" stance. In an alternative embodiment, the graduated increasing thickness of the more rigid portion provides additional support to the front of a dancer's foot, such that a dancer who was already capable of achieving "en pointe" stance is not negatively impacted by the existence of the graduated increasing thickness in the ballet pointe shoe 100.

As depicted in FIG. 1, the more rigid portion may comprise only the shank 110. In another embodiment, as depicted in FIG. 2, the more rigid portion may comprise the shank 110 and a toe wedge 200. In yet another embodiment, the more rigid portion may comprise the shank 110 and at least one other component.

In an embodiment, the remaining thickness of the more rigid portion toward the heel 106 may be of uniform thickness or may vary in thickness throughout. In such an embodiment, the remaining thickness may be thicker in one area to provide further support for a dancer's foot, such as a slight increased thickness where the arch of a dancer's foot meets the more rigid portion of the ballet pointe shoe 100.

In an embodiment, the length of the graduated increasing thickness, should be a distance sufficient to support the dancer's toes and the ball of her foot, while not extending past the ball of her foot so as to interfere with the flexibility of the arch of her foot. It is beneficial that the dancer be able to achieve other ballet stances and transition between the various stances with limited interference from the graduated increasing thickness. For example, the dancer should be able to roll through from "en pointe" to "demi-pointe" (standing on the ball of the foot) and vice versa without negative interference from the graduated increasing thickness.

In an alternative embodiment, the length of the graduated thickness may extend past the ball of the dancer's foot. In such an alternative embodiment, the toe wedge 200 comprises a more flexible or less rigid piece at and/or around the dancer's ball of her foot so as to not interfere with the flexibility of her foot. For example, the toe wedge 200 may be made of one or more materials to provide the more rigid piece and one or more materials to provide the less rigid piece at and/or around the dancer's ball of her foot. The more rigid piece and the less rigid piece may be coupled together, for example via bonding.

In an embodiment, the more rigid portion may be manufactured out of a single material or multiple materials. The single material or multiple materials may comprise a single layer or multiple layers. Exemplary types of materials may include felt, leather, suede, burlap, glue, canvas, wood, plastic, paper-based materials, cork and composite materials, or some combination thereof. In one embodiment, the more rigid portion may be made out of a single rigid material, such as, for example, a block of wood. In this embodiment, the more rigid portion may also comprise a soft covering, such as suede or canvas. The soft covering may provide a more comfortable surface on which a dancer's foot may rest and could provide additional friction, if necessary. In another embodiment, the more rigid portion may be molded out of plastic. In yet another embodiment, the more rigid portion may be built up of layers of flexible materials such as leather and glue, such that the composite material, when dry, offers the desired rigidity. Such an embodiment may then be cut into the desired shape and thickness by cutting or grinding.

In an embodiment, the more rigid portion may be manufactured using various techniques. Exemplary manufacturing techniques may include cutting, grinding, molding, matrix splitting, or some combination thereof. In an embodiment, the more rigid portion is manufactured by hand. In such an embodiment, the more rigid portion could be hand carved, molded, sculpted, sanded, grinded, glued, sewn, or some combination thereof. In another embodiment, the more rigid portion may be manufactured by a machine. In such an embodiment, the more rigid portion could be manufactured using a mold, a lathe, a grinder, a sewing machine, or any other known machine suitable for the purposes of manufacturing the more rigid portion with the desired characteristics.

In yet another embodiment, the more rigid portion may be manufactured by a combined process of manufacturing by hand and manufacturing by machine. In such an embodiment, the materials which make up the more rigid portion could be combined by hand, and then a machine used to shape the more rigid portion into the desired form and thickness. Alternatively, in such an embodiment, the materials which make up the more rigid portion may be built up of layers of flexible materials such as leather and glue by a machine, such that the composite material, when dry, offers the desired rigidity. Such an embodiment may then be manually formed into the desired shape and thickness by cutting, grinding, or any other manual means appropriate for achieving the desired shape and thickness.

Among possible embodiments, the thickest part of the more rigid portion near the platform 104 may range in thickness from about 11 to 17 millimeters. For example, in some embodiments, the thickest part of the more rigid portion near the platform 104 may range in thickness from about 13 to 15 millimeters; however, in other embodiments, the thickest part of the more rigid portion may range in thickness from about 11 to 13 millimeters. In still other embodiments the thickest part of the more rigid portion may range in thickness from about 15 to 17 millimeters. In some embodiments, a thickness of about 14.3 millimeters of the thickest portion may be desired.

Among possible embodiments, the remaining thickness of the more rigid portion toward the heel 106 may range in thickness from about 5 to 9 millimeters. For example, in some embodiments, the remaining thickness of the more rigid portion toward the heel 106 may range in thickness from about 5 to 7.5 millimeters; however, in other embodiments, the remaining thickness of the more rigid portion may range in thickness from about 7.5 to 9 millimeters. In some embodiments, a thickness of about 7.3 millimeters of the thinner end may be desired.

Figure 3A:
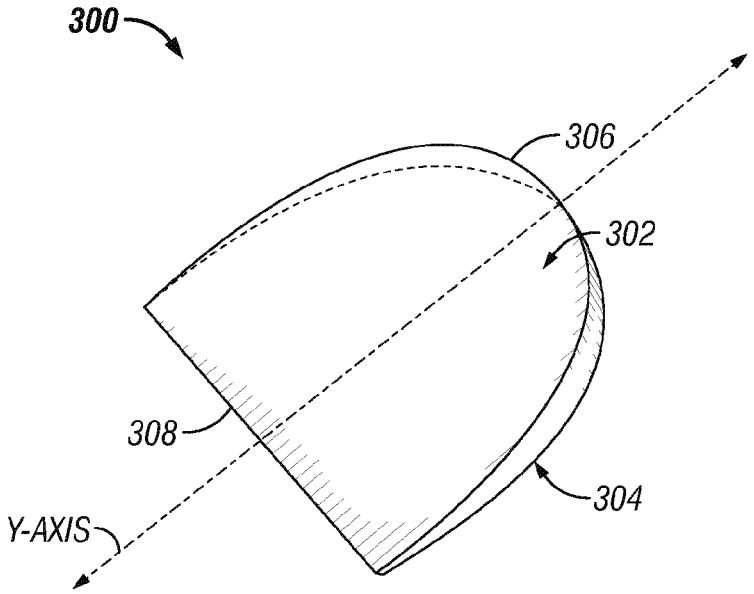
FIGS. 3A to 3C illustrate a toe wedge according to an embodiment of the disclosure.
Figure 3B:
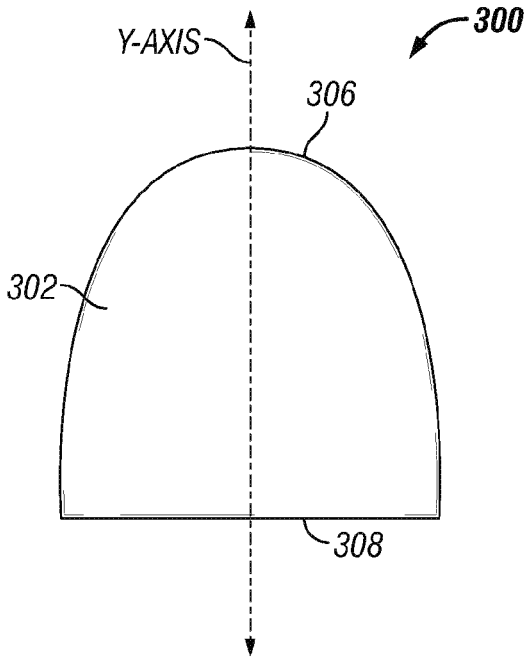
Figure 3C:
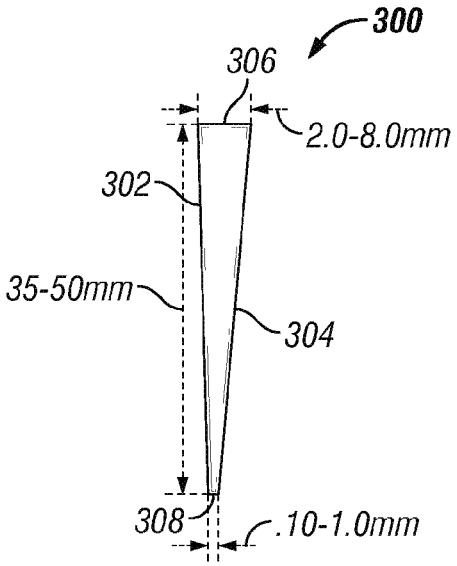

Turning now to FIGS. 3A, 3B and 3C, an embodiment of a toe wedge 300, similar to the toe wedge 200 in FIG. 2A, for use in the ballet pointe shoe 100 is illustrated. Hereinafter the toe wedge 300 may be referred to as the "simple toe wedge 300." The simple toe wedge 300 comprises a top surface 302, a bottom surface 304, a thicker end 306 and a thinner end 308. The simple toe wedge 300 may be configured of such a shape and size to fit into the ballet pointe shoe 300, an embodiment of which is illustrated in FIG. 2A, with the thicker end 306 towards the platform 104 and the thinner end 308 towards the heel 106. Wherein the simple toe wedge 300 is located in the ballet pointe shoe 100 above and approximately parallel to the sole 108, below the upper 112, and below a dancer's toes when the ballet pointe shoe 100 is in use.

In an embodiment, the simple toe wedge 300 is shaped to fit into the ballet pointe shoe 100. In such an embodiment, the thicker end 306 may be rounded, as depicted in FIGS. 3A and 3B, or squared or hexagonal or any other shape appropriate to fit into the ballet pointe shoe 100 with the thicker end 306 towards the platform 104. Further, in such an embodiment, the thinner end 308 may be squared, as depicted in FIGS. 3A and 3B or rounded or hexagonal or any other shape appropriate to fit into the ballet pointe shoe with the thinner end towards the heel 106.

In an embodiment, the simple toe wedge 300 is coupled to the shank 110, an embodiment of which is depicted in FIG. 2A. Coupled as used herein means directly or indirectly connected, and may be achieved using any method appropriate for coupling components in the manufacture of the ballet pointe shoe 100 such as, for example, by use of an adhesive, stitching, nails, or some combination thereof. In such an embodiment, the simple toe wedge 300 may be coupled to the top of the shank 110 or the bottom of the shank 110. Coupling of the simple toe wedge 300 to the shank 110 prevents the simple toe wedge 300 from moving when the ballet pointe shoe 100 is in use by a dancer. The act of coupling the simple toe wedge 300 and the shank 110 may be completed during manufacture of the ballet pointe shoe 100 or after manufacture of the ballet pointe shoe 100. In such an embodiment, the simple toe wedge 300 may also be coupled to the toebox 102. In an embodiment, the simple toe wedge 300 may rest entirely against the shank 110 or may extend past the shank 110 into the toebox 102. If the simple toe wedge 300 rests entirely against the shank 110, the combination of the simple toe wedge 300 and the shank 110 may form at least part of a side of the toebox 102. If the simple toe wedge 300 extends past the shank 110 into the toebox, the simple toe wedge 300 may be coupled to the shank and also coupled to the toebox 102.

In an alternate embodiment, the simple toe wedge 300 is inserted into the ballet pointe shoe 100 and not coupled to any other part of the ballet pointe shoe 100, but may directly or indirectly contact the described points without independent coupling. In such an embodiment, the simple toe wedge 300 would be held in place by a dancer's foot and her body weight and potentially its fit within the ballet pointe shoe 100 or specifically within the toebox 102. In such an embodiment, the simple toe wedge 300 may be manufactured of such a shape that it rests entirely against the shank 110 or may extend past the shank 110 into the toebox 102.

In another embodiment, the simple toe wedge 300 is comprised as a portion of the shank 110 such as a graduated thickening in the shank 110 in and potentially near the toebox 102, as depicted in FIG. 1. In such an embodiment, the shank 110 and simple toe wedge 300 may be a single combined fabrication. For instance, the shank 110 and simple toe wedge 300 could be formed using a mold and a single type of material or multiple types of materials. In another instance the integral shank 110 and the simple toe wedge 300 could be made out of a single piece of material by starting with a thick piece and removing material. The single combined fabrication comprising the shank 110 and simple toe wedge 300 may also be coupled to the toebox 102.

In another embodiment, the simple toe wedge 300 is configured to fit inside the toebox 102. In such an embodiment, the bottom surface 304 of the simple toe wedge 300 may be beveled along the perimeter to fit into the toebox 102. Further, the simple toe wedge 300 may be coupled to the toebox 102. Coupling of the simple toe wedge 300 to the toebox 102 prevents the simple toe wedge 300 from moving when the ballet pointe shoe 100 is in use by a dancer.

In yet another embodiment, the simple toe wedge 300 comprises a portion of the toebox 102. In such an embodiment, the simple toe wedge 300 and toebox 102 may be a single combined fabrication. For example, the simple toe wedge 300 and toebox 102 could be formed using a mold and a single type of material or multiple types of materials. In another instance the simple toe wedge 300 and toebox 102 could be made out of a single piece of material. In such an embodiment, the simple toe wedge 300 and toebox 102 may be coupled to the shank 110.

In another embodiment, the simple toe wedge 300 comprises a portion of the toebox 102 and a portion of the shank 110. In such an embodiment, the simple toe wedge 300, toebox 102 and shank 110 may be a single combined fabrication. For example, the simple toe wedge 300, toebox 102, and shank 110 could be formed using a mold and a single type of material or multiple types of materials. In another instance the simple toe wedge 300, toebox 102, and shank 110 could be could be carved out of a single piece of material.

According to an embodiment, the simple toe wedge 300 has a rigidity similar to the rigidity of the shank 110 depicted in FIGS. 1 and 2. In another embodiment, the simple toe wedge 300 may have a rigidity equal to the rigidity of the shank 110. In yet another embodiment, the simple toe wedge 300 may have a rigidity slightly less than the rigidity of the shank 110, or slightly more than the rigidity of the shank 110. In a preferred embodiment, the rigidity of the simple toe wedge 300 is similar to or equal to the rigidity of the shank 110. In another embodiment, the rigidity of the simple toe wedge 300 is less than or equal to the rigidity of the shank 110.

Among possible embodiments, the thickest end 306 of the simple toe wedge 300 may range in thickness from about 2 to 8 millimeters. For example, in some embodiments, the thicker end 306 of the simple toe wedge 300 may range in thickness from about 4 to 6 millimeters; however, in other embodiments, the thicker end 306 of the simple toe wedge 300 may range in thickness from about 2 to 4 millimeters. In still other embodiments, the thicker end 306 of the simple toe wedge 300 may range in thickness from about 6 to 8 millimeters. In some embodiments, a 5 millimeter thickness of the thicker end 306 may be desired.

Among possible embodiments, the thinner end 308 of the simple toe wedge 300 may range in thickness from about 0.10 to 2 millimeters. In some embodiments, the thinner end 308 of the simple toe wedge 300 may range in thickness from about 0.10 to 1 millimeter; however, in other embodiments, the thinner end 308 of the simple toe wedge 300 may range in thickness from about 1 to 2 millimeters. In some embodiments, a thickness of about 0.5 millimeters of the thinner end 308 may be desired. In at least some embodiments, it is desirable to minimize the feel of a step or ledge at the end of the insert, so minimizing the thickness of the thin end is desirable while at the same time balancing the desire to maintain the function and durability of the wedge.

In an embodiment, the distance between the thicker end 306 and the thinner end 308, measured along the y-axis of top surface 302, should be a distance sufficient to support the dancer's toes and the ball of her foot, while not extending past the ball of her foot so as to interfere with the flexibility of the arch of her foot, as discussed above with respect to the graduated increasing thickness of the ballet pointe shoe 100, as depicted in FIG. 1. For example, the thicker end 306 and the thinner end 308, measured along the y-axis of top surface 302, may extend to about the edge of the toe box 102.

Alternatively, the distance between the thicker end 306 and the thinner end 308, measured along the y-axis of top surface 302, may extend past the ball of the dancer's foot. In such an alternative embodiment, the toe wedge 300 comprises a more flexible or less rigid piece at and/or around the dancer's ball of her foot so as to not interfere with the flexibility of her foot. For example, the toe wedge 300 may be made of a plurality of materials bonded together to provide the more rigid piece and the less rigid piece at and/or around the dancer's ball of her foot.

According to an embodiment, the distance between the thicker end 306 and the thinner end 308, measured along the y-axis of top surface 302, may range from about 25 to 60 millimeters; however, in other embodiments, the distance between the thicker end 306 and the thinner end 308, measured along the y-axis of top surface 302, may range from about 30 to 55 millimeters. In still other embodiments, the distance between the thicker end 306 and the thinner end 308, measured along the y-axis of top surface 302, may range from about 35 to 50 millimeters. The distance between the thicker end 306 and the thinner end 308, measured along the y-axis of top surface 302, may depend upon the size of the ballet pointe shoe 100. In other words, the distance between the thicker end 306 and the thinner end 308, measured along the y-axis of top surface 302, may be greater in a larger size ballet pointe shoe 100 than a smaller size ballet pointe shoe 100.

In an embodiment, the simple toe wedge 300 may be manufactured by similar method and materials as the more rigid portion of the ballet pointe shoe as discussed above with respect to FIGS. 1 and 2.

Figure 4A:
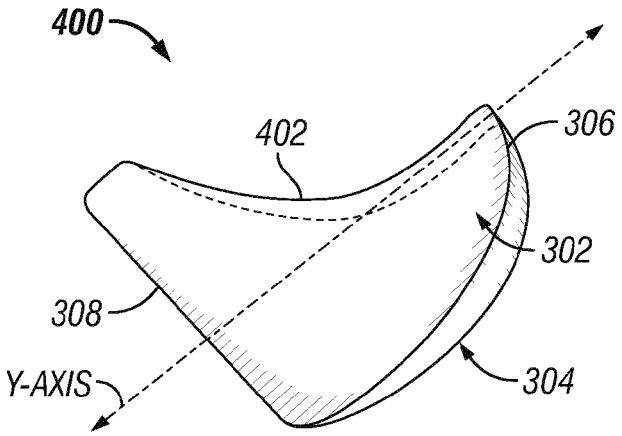
FIGS. 4A to 4C illustrate a toe wedge according to another embodiment of the disclosure.
Figure 4B:
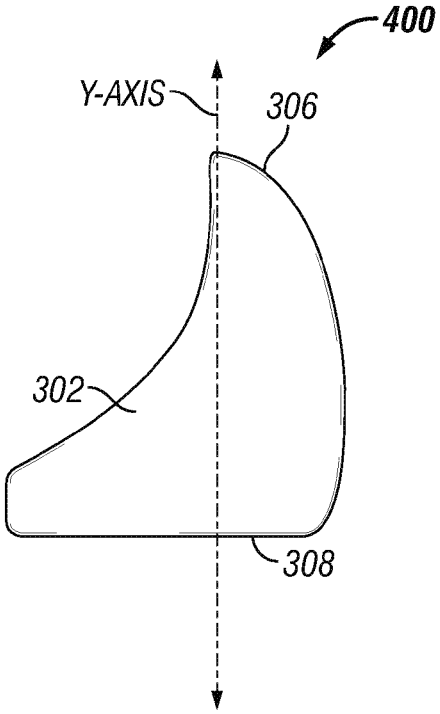
Figure 4C:
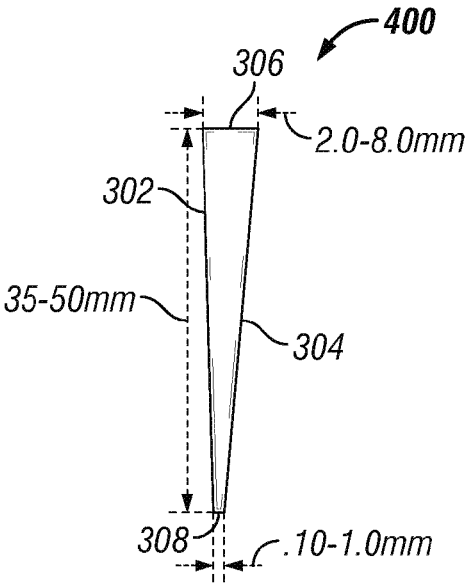

Turning now to FIGS. 4A, 4B and 4C, an embodiment of a toe wedge 400 for use in a ballet pointe shoe 100 is illustrated. Hereinafter the toe wedge 400 may be referred to as the "anti-twist toe wedge." Similar to the simple toe wedge 300 depicted in FIGS. 3A, 3B and 3C, the subject anti-twist toe wedge 400 comprises a top surface 202, a bottom surface 204, a thicker end 206 and a thinner end 204. A portion of the anti-twist toe wedge 400 may be diminished in thickness to approximate the space occupied by a big toe or a significant portion of a big toe, resulting in an inset curve 402. In such an embodiment, the diminished thickness allows a dancer's big toe to rest closer to the sole 108 of the ballet pointe shoe 100 than the ballet dancer's remaining toes. In this embodiment, the anti-twist toe wedge 400 assists the front of the foot in twisting one direction while simultaneously forcing the heel 106 of the foot to twist the opposite direction. This "propeller" effect is helpful in counteracting the natural twisting motion inherent in some dancers' natural foot placement in the ballet pointe shoe 100. In essence, this embodiment of the anti-twist toe wedge 400 results in an anti-twist characteristic to the ballet pointe shoe.

In an embodiment, the inset curve 402 is at a ninety degree or other sharp angle from the top surface 302 to the bottom surface 304 of the anti-twist toe wedge 400. In another embodiment, the inset curve 402 may be gradually sloped down from the top surface 302 to the bottom surface 304. This sloping inset curve 402 allows a ballet dancer's big toe to gradually drop closer to the sole 108 than her remaining toes. In such an embodiment, the slope may be achieved by manufacturing a single or multiple pieces of rigid material with a slope. In another embodiment, the slope may be achieved by covering the rigid anti-twist toe wedge 400 with a soft material in a manner such that the soft material stretches across the rigid material to create a gradual slope where one did not previously exist.

As described above with respect to FIGS. 3A, 3B and 3C, the anti-twist toe wedge 400 is configured and constructed to fit into the ballet pointe shoe 100. Additionally, in an embodiment, the diminished portion of the anti-twist toe wedge 400 may be achieved by building the required shape including the inset curve 402 using appropriately shaped and sized segments of material. In an alternative embodiment, the diminished portion of the anti-twist toe wedge 400 may be achieved by starting with a portion of material or composite materials, and removing material to create the diminished portion, resulting in an inset curve.

Figure 5:
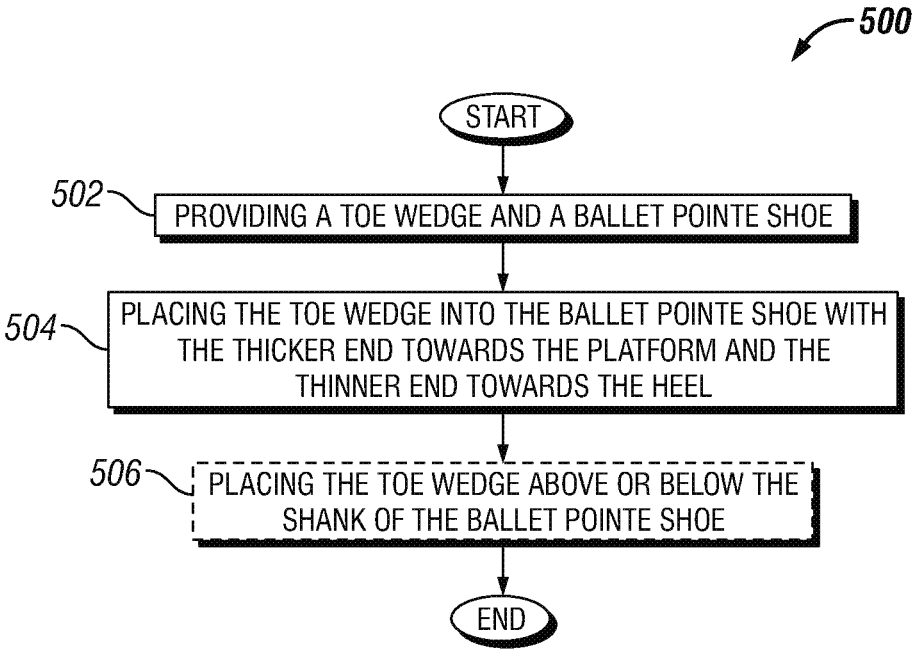
FIG. 5 illustrates a method of using a toe wedge in a ballet pointe shoe.

Turning now to FIG. 5, a method 500 of using a toe wedge in a ballet pointe shoe is illustrated. At block 502, a toe wedge and a ballet pointe shoe are provided. The toe wedge has a thicker end and a thinner end. The ballet pointe shoe has a toebox, a platform, a heel, and a shank. The toe wedge is then placed into the ballet pointe shoe with the thicker end towards the platform and the thinner end towards the heel at block 504.

In an embodiment, the method of using the toe wedge in the ballet pointe shoe may comprise placing the toe wedge above the shank or below the shank, as shown at block 506. For example, the toe wedge could be laid on top of the shank and then covered with a piece of material, such as suede or canvas using an adhesive to assist in coupling the toe wedge to the shank, which may also provide a softer surface for the dancer's foot. In another embodiment, the method of using the toe wedge in the ballet pointe shoe may comprise placing the toe wedge below the shank. For instance, the toe wedge could be placed below the shank during manufacture of the ballet pointe shoe, and secured into the support structure of the ballet pointe shoe. In another example, a pre-manufactured ballet pointe shoe may partially or entirely disassembled so as to lift the shank a sufficient distance to allow the toe wedge to be placed below it inside the ballet pointe shoe, and then the shank replaced in the shoe with any necessary adjustments made to accommodate the increased thickness of the ballet pointe shoe created by the toe wedge.

In an embodiment, the method of using the toe wedge in the ballet pointe shoe may comprise placing the toe wedge in the ballet pointe shoe as part of the shank. In such an embodiment, the toe wedge and the shank may be a single combined fabrication. In another embodiment, the method of using the toe wedge in the ballet pointe shoe may comprise placing the toe wedge in the ballet pointe shoe as part of the toebox. In such an embodiment, the toe wedge and toebox may be a single combined fabrication.

In an embodiment, the method of using the toe wedge in the ballet pointe shoe may comprise permanently attaching the toe wedge to the ballet pointe shoe. In such an embodiment, the toe wedge may be placed in the ballet pointe shoe and glued, stitched or nailed to the shank such that removal of the toe wedge from the shoe after placement would result in damage to the ballet pointe shoe. Alternatively, in another embodiment, the method of using the toe wedge in the ballet pointe shoe may comprise releasably attaching the toe wedge to the ballet pointe shoe. In such an embodiment, the toe wedge may be placed in the ballet pointe shoe and attached using a temporary or semi-permanent adhesive, a hook and loop style fastener or other temporary or removable fastener known to those of skill in the art, such that the toe wedge does not move during use of the shoe by a dancer, but can be removed from the ballet pointe shoe if desired.

In an embodiment, the toe wedge disclosed above is consistent for use as part of a method of assisting a ballet dancer in improving the form of an "en pointe" stance, which comprises assessing a ballet dancer's need for assistance with achieving "en pointe" stance, selecting a toe wedge, and fitting the ballet dancer in a ballet pointe shoe with the toe wedge. The method may further comprise observing the ballet dancer's form to "en pointe" stance in the ballet pointe shoe fitted with the toe wedge and adjusting the toe wedge placement. This method may also comprise replacing one embodiment of the toe wedge with another embodiment of the toe wedge depending on the ideal embodiment for assisting the ballet dancer in achieving "en pointe" stance. For example, if a dancer only requires assistance in "getting over" onto the platform of the ballet pointe shoe, an embodiment such as the simple toe wedge 300 may be ideal for the dancer. However, if a dancer requires assistance in "getting over" onto the platform and requires correction of a twist in her stance to achieve the straight line desired in proper "en pointe" stance (i.e. the dancer is a "twister"), the anti-twist toe wedge 400 may be ideal for the dancer due to its anti-twist characteristics.

In another embodiment, the ballet pointe shoe disclosed above is consistent for use as part of a method of dancing "en pointe", which comprises a dancer donning the ballet pointe shoe comprising a more rigid portion with a graduated increasing thickness toward the platform, the dancer positioning her foot properly inside the ballet pointe shoe, engaging the appropriate body muscles, and achieving proper "en pointe" stance.

Having described the various tools, systems, and method herein, embodiments may include, but are not limited to:

In an embodiment, a ballet pointe shoe having a sole, an upper, a toebox, a platform, a shank, and a heel comprises a more rigid portion and a less rigid portion. The more rigid portion is above the sole and below the upper. The more rigid portion has a graduated increasing thickness at least partially inside the toebox and toward the platform. The more rigid portion diminishes to a remaining thickness toward the heel. The more rigid portion may be configured to fit completely inside the toebox. The more rigid portion may comprise the shank. The more rigid portion may comprise the shank and at least one additional component. The remaining thickness toward the heel may not be of uniform thickness. A segment of the more rigid portion may be diminished in thickness to approximate the space occupied by a big toe or a significant portion of a big toe, resulting in an inset curve.

In an embodiment, a toe wedge for use with a ballet pointe shoe having a sole, an upper, a toebox, a platform, a shank, and a heel comprises a top surface, a bottom surface, a thicker end, and a thinner end. The toe wedge is configured to fit into the ballet pointe shoe with the thicker end towards the platform and the thinner end towards the heel. The toe wedge is configured to fit into the ballet pointe shoe at least partially inside the toebox and between the sole and the upper. The toe wedge may be configured to fit completely inside the toebox. The bottom surface may be beveled along its perimeter. The toe wedge and the shank may be a single combined fabrication. The toe wedge and the toebox may be a single combined fabrication. The toe wedge may be above the shank. The toe wedge may be below the shank. The toe wedge may have a rigidity similar to the rigidity of the shank. A segment of the toe wedge may be diminished in thickness to approximate the space occupied by a big toe or a significant portion of a big toe, resulting in an inset curve. The inset curve may be sloped from the top surface to the bottom surface.

In an embodiment, a method of using a toe wedge in a ballet pointe shoe comprises placing the toe wedge into the ballet pointe shoe. The toe wedge comprises a thicker end and a thinner end. The ballet pointe shoe has a sole, an upper, a toebox, a platform, a shank, and a heel. The toe wedge is placed into the ballet pointe shoe at least partially in the toebox with the thicker end towards the platform and the thinner end towards the heel. The toe wedge may be placed above the shank or below the shank. The toe wedge may be placed in the ballet pointe shoe as part of the shank. The toe wedge may be placed in the ballet pointe shoe and at least one of permanently attached or releasably attached.

The following brief definition of terms shall apply throughout the foregoing detailed description and the application in its entirety:

The term "comprising" means including but not limited to, and should be interpreted in the manner it is typically used in the patent context;

The phrases "in an embodiment," "according to an embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "preferably," "possibly," "typically," "optionally," "for example," or "might" (or other such language) be included or have a characteristic, that particular component or feature is not required to be included or to have the characteristic. Such component or feature may be optionally included in some embodiments, or it may be excluded While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A ballet pointe shoe, comprising:
an upper,
a heel;
a sole;
a toebox that comprises:
a longitudinal axis through a center of the toebox adapted to run in a direction along a dancer's foot between the heel and toes when the dancer is wearing the ballet pointe shoe, and
a lateral cross-section across a lateral axis perpendicular to the longitudinal axis;
a platform;
a shank; and
a toe wedge;
wherein the toe wedge is more rigid than the upper;
wherein the toe wedge is above the sole and below a layer that covers the shank and contacts a bottom of the dancer's foot when the dancer is wearing the ballet pointe shoe;
wherein the toe wedge has a graduated increasing thickness at least partially inside the toebox and toward the platform;
wherein the toe wedge diminishes to a remaining thickness toward the heel;
wherein the toe wedge is configured to end before a beginning of an arch of the dancer's foot when the dancer is wearing the ballet pointe shoe;
wherein the toe wedge is not diminished in thickness across the lateral cross-section of the toebox; and
wherein the toe wedge is directly connected to the shank.

2. The ballet pointe shoe of claim 1, wherein the toe wedge is configured to fit completely inside the toebox.

3. The ballet pointe shoe of claim 1, wherein the remaining thickness toward the heel is not of uniform thickness.

4. The ballet pointe shoe of claim 1, wherein the toe wedge and the shank are a single combined fabrication.

5. The ballet pointe shoe of claim 1, wherein the toe wedge is directly connected to the shank via at least one of adhesive, stitches, or nails.

6. The ballet pointe shoe of claim 1, wherein the layer is a fabric layer.

7. A ballet pointe shoe, comprising:
a sole;
a heel;
an upper;
a toebox that comprises:
a longitudinal axis through a center of the toebox adapted to run in a direction along a dancer's foot between the heel and toes when the dancer is wearing the ballet pointe shoe, and
a lateral cross-section across a lateral axis perpendicular to the longitudinal axis;
a platform;
a shank; and
a toe wedge comprising a top surface, a bottom surface, a thicker end, and a thinner end;
wherein the toe wedge fits into the ballet pointe shoe with the thicker end towards the platform and the thinner end towards the heel;
wherein the toe wedge is at least partially inside the toebox and between the sole and the shank;
wherein the toe wedge is configured to end before a beginning of an arch of the dancer's foot when the dancer is wearing the ballet pointe shoe;
wherein the thicker end of the toe wedge is not diminished in thickness across the lateral cross-section of the toebox; and
wherein the toe wedge is directly connected to the shank.

8. The ballet pointe shoe of claim 7, wherein the toe wedge is completely inside the toebox.

9. The ballet pointe shoe of claim 7, wherein the bottom surface of the toe wedge is beveled along its perimeter.

10. The ballet pointe shoe of claim 7, wherein the toe wedge and the shank are a single combined fabrication.

11. The ballet pointe shoe of claim 7, wherein the toe wedge and the toebox are a single combined fabrication.

12. The ballet pointe shoe of claim 7, wherein the toe wedge has a rigidity similar to the rigidity of the shank.

13. The ballet pointe shoe of claim 7, wherein the thicker end at the platform comprises a uniform thickness.

14. The ballet pointe shoe of claim 7, wherein the thicker end of the toe wedge has a thickness of 2 to 8 millimeters.

15. The ballet pointe shoe of claim 7, wherein length of the toe wedge between the thicker end and the thinner end is 25 to 60 millimeters.

16. The ballet pointe shoe of claim 7, wherein the toe wedge is directly connected to the shank via at least one of adhesive, stitches, or nails.

17. A method of using a toe wedge in a ballet pointe shoe, comprising:

placing a toe wedge comprising a thicker end and a thinner end into a ballet pointe shoe that comprises a sole, an upper, a toebox, a platform, a shank, and a heel;

wherein the toebox comprises:

a longitudinal axis through a center of the toebox adapted to run in a direction along a dancer's foot between the heel and toes when the dancer is wearing the ballet pointe shoe, and a lateral cross-section across a lateral axis perpendicular to the longitudinal axis;

wherein the toe wedge is placed into the ballet pointe shoe at least partially in the toebox with the thicker end towards the platform and the thinner end towards the heel;

wherein the toe wedge is placed into the ballet shoe at a position selected from the group consisting of between the sole and the shank and between the sole and a layer that covers the shank and contacts a bottom of the dancer's foot when the dancer is wearing the ballet pointe shoe;

wherein the toe wedge is configured to end before a beginning of an arch of the dancer's foot when the dancer is wearing the ballet pointe shoe;

wherein the thicker end of the toe wedge is not diminished in thickness across the lateral cross-section of the toebox; and wherein the toe wedge is directly connected to the shank.

18. The method of claim 17, wherein the toe wedge and the shank are a single combined fabrication.

19. The method of claim 17, wherein the toe wedge is directly connected to the shank via at least one of adhesive, stitches, or nails.

20. The method of claim 17, wherein the layer is a fabric layer.

* * * * *